US011732322B2

(12) United States Patent
Yang et al.

(10) Patent No.: US 11,732,322 B2
(45) Date of Patent: Aug. 22, 2023

(54) COLD ROLLED STEEL SHEET

(71) Applicant: Algoma Steel Inc., Sault Sainte Marie (CA)

(72) Inventors: Shuhe Yang, Sault Sainte Marie (CA); Sang Hyun Cho, Sault Sainte Marie (CA)

(73) Assignee: Algoma Steel Inc., Sault Ste. Marie (CA)

( * ) Notice: Subject to any disclaimer, the term of this patent is extended or adjusted under 35 U.S.C. 154(b) by 0 days.

(21) Appl. No.: 17/584,778

(22) Filed: Jan. 26, 2022

(65) Prior Publication Data

US 2022/0243297 A1 Aug. 4, 2022

Related U.S. Application Data

(60) Provisional application No. 63/143,448, filed on Jan. 29, 2021.

(51) Int. Cl.

| | |
|---|---|
| ***C21D 9/46*** | (2006.01) |
| ***C21D 8/02*** | (2006.01) |
| ***C21D 6/00*** | (2006.01) |
| ***C22C 38/50*** | (2006.01) |
| ***C22C 38/48*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C22C 38/44*** | (2006.01) |

(52) U.S. Cl.

CPC ..... *C21D 9/46* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/48* (2013.01); *C22C 38/50* (2013.01); *C21D 2211/005* (2013.01); *C21D 2211/009* (2013.01)

(58) Field of Classification Search

None

See application file for complete search history.

(56) References Cited

U.S. PATENT DOCUMENTS

2015/0337408 A1* 11/2015 Schulz ..... C22C 38/02 420/110

* cited by examiner

*Primary Examiner* — Anthony M Liang

(74) *Attorney, Agent, or Firm* — Dinsmore & Shohl LLP; Weston R. Gould

(57) ABSTRACT

Provided is a steel sheet having: ferrite and pearlite composing 80% or more, in area fraction, of the microstructure; yield strength of 60 ksi or more; elongation of at least 23%; an n-value of at least 0.14; incidental impurities; and, in weight percent:

C: 0.03~0.10
Si: 0~0.6
Mn: 0.5~1.5
Cu: 0~1.0
Ni: 0~1.0
Nb: 0~0.06
Ti: 0~0.1
Mo: 0~0.5%
Cr: 0~1.0
Al: 0~0.06
N: 0.0001~0.006
Ca: 0~0.006
P: 0~0.02
S: 0~0.005.

4 Claims, 6 Drawing Sheets

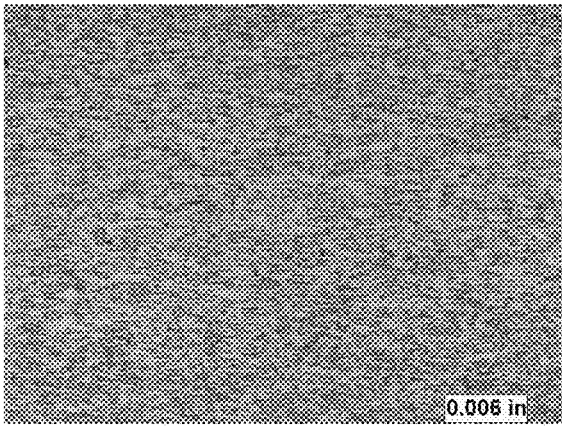
Fig.1 Nital Etch-Middle microstructure – Full hard Strip(x200)
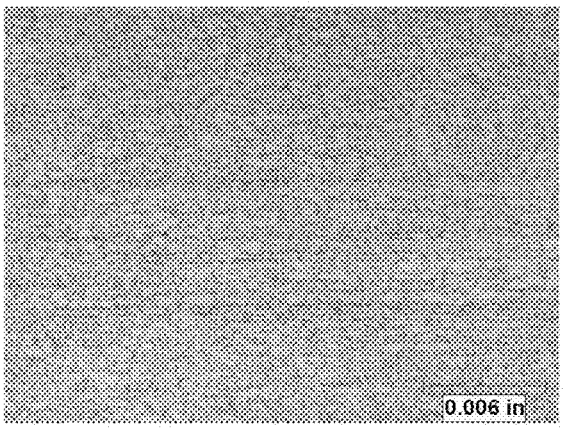
Fig. 2 Nital Etch - Middle microstructure annealed (x200)

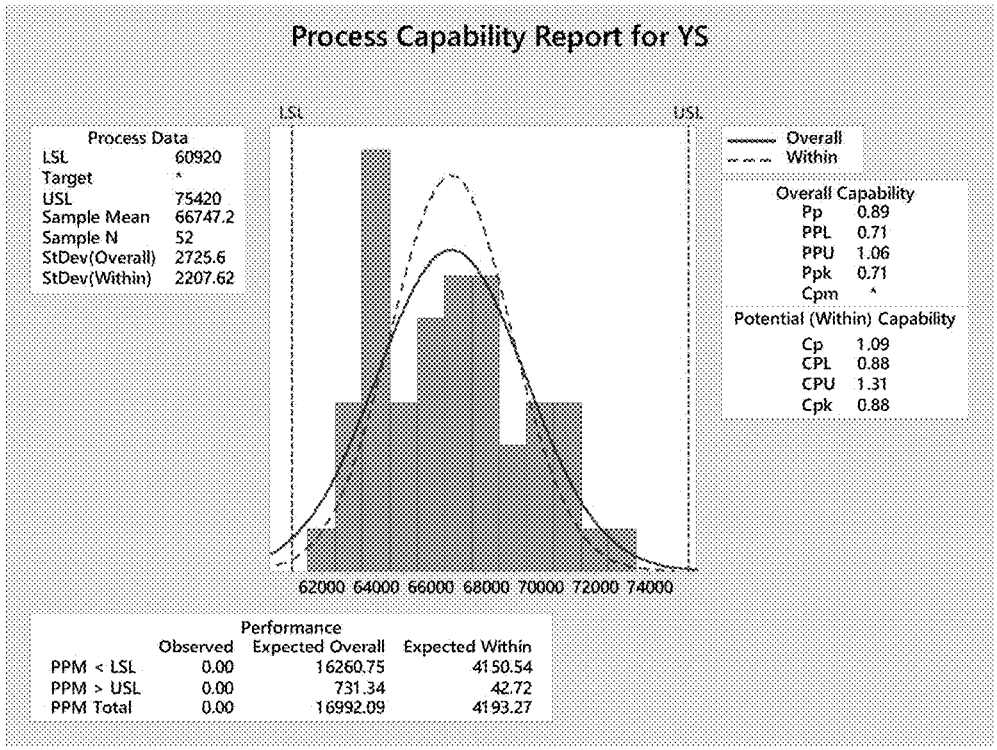
Fig 3: L-orientation YS Capability
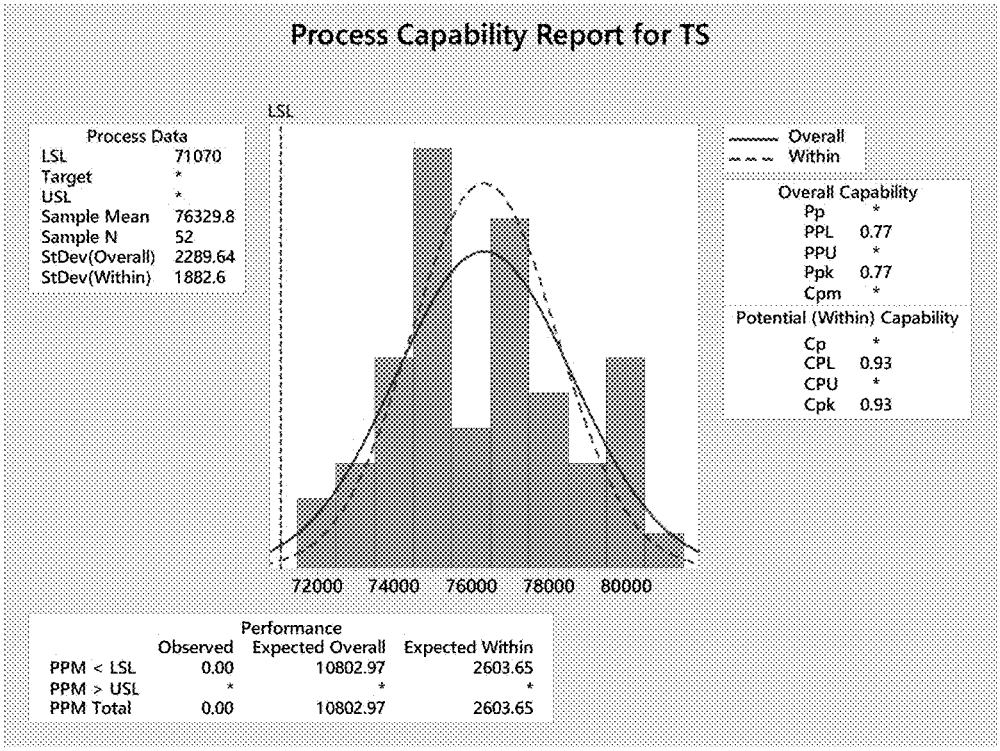
Fig 4 : L-orientation TS Capability

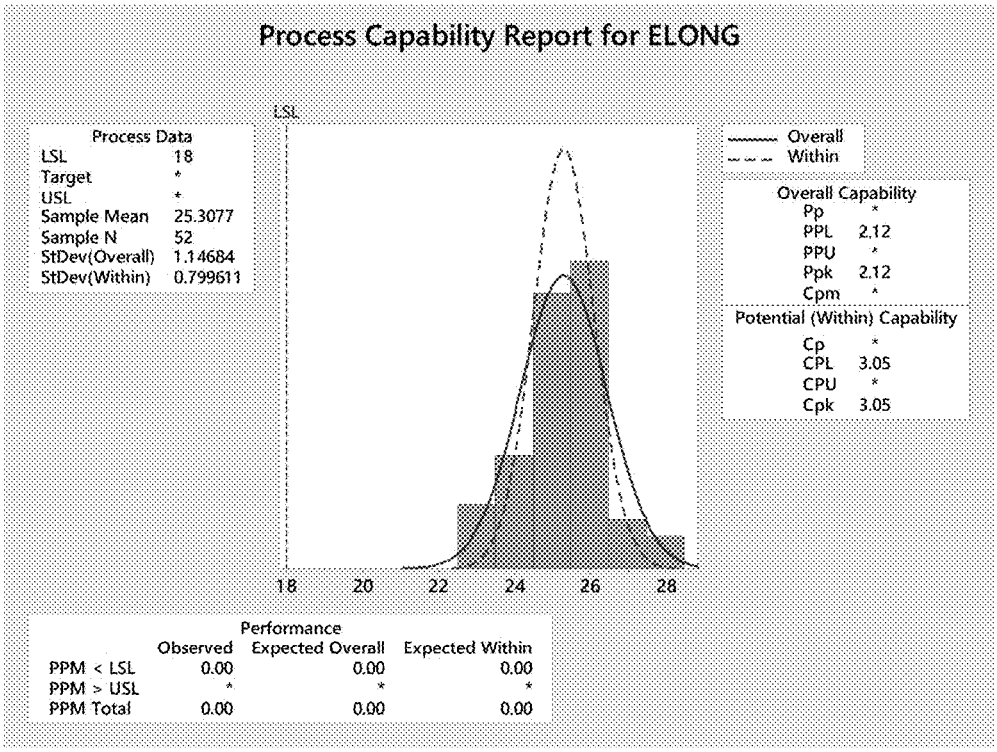
Fig 5: L-orientation Elongation Capability
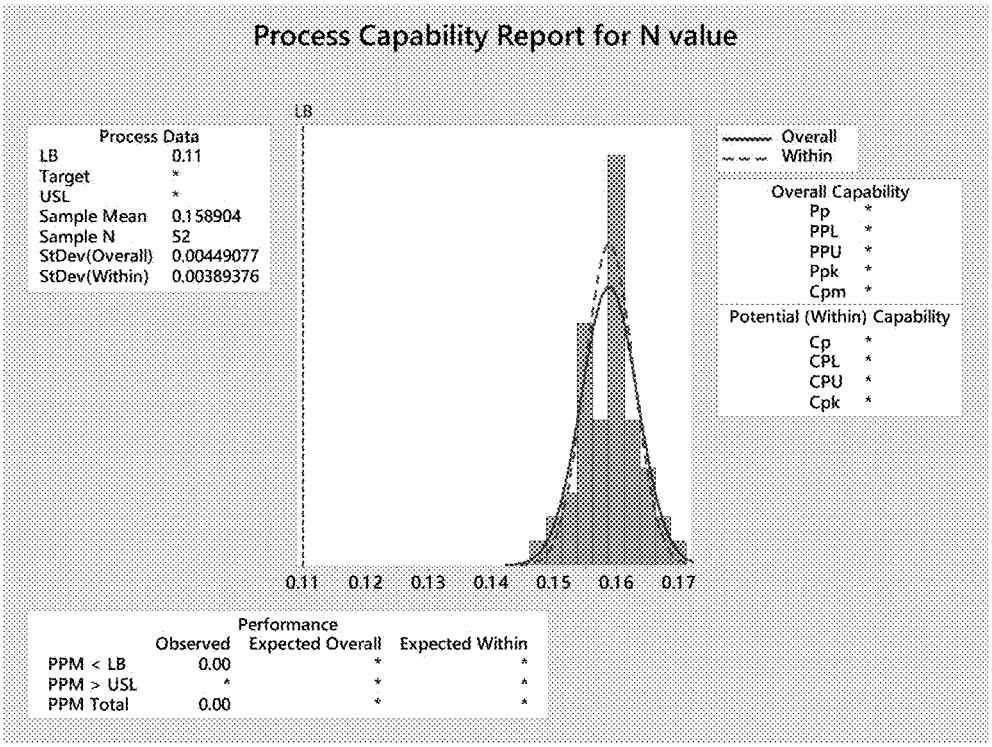
Fig 6: L-orientation n value Capability

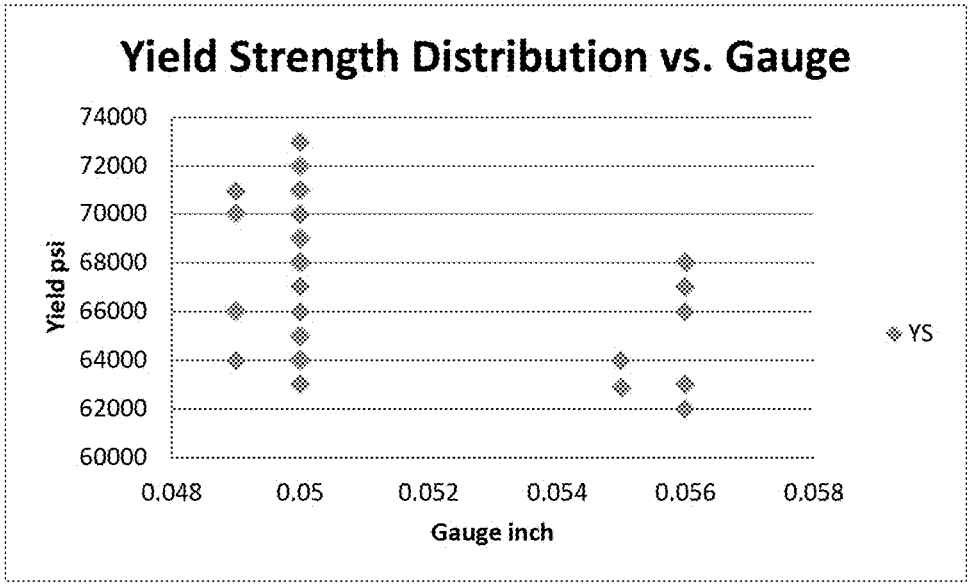
Fig 7: L-orientation Yield Strength vs. Gauge

| # | ID | Gauge (mm) | Orientation | .2 OS YS (mpa) | UTS (mpa) | 2" Elong | N Value | C | Mn | S | P | Si | Cr | Ni | Cu | Mo | Alt | V | Nb | Ti | Ca | Sn | N | FT F | CT F | Hot Spot | Cold Spot | Reduction % |
|---|---|---|---|---|---|---|---|---|---|---|---|---|---|---|---|---|---|---|---|---|---|---|---|---|---|---|---|---|
| 1 | AC19 111B | 1.27 | L | 465 | 532 | 26 | 0.165 | 0.058 | 0.801 | 0.003 | 0.015 | 0.201 | 0.040 | 0.027 | 0.05 | 0.011 | 0.031 | 0.002 | 0.015 | 0.060 | 0.003 | 0.003 | 0.0036 | 1647 | 1166 | 1221 | 1205 | 0.64 |
| 2 | AC19 115 | 1.27 | L | 469 | 540 | 28 | 0.161 | 0.058 | 0.801 | 0.003 | 0.015 | 0.201 | 0.040 | 0.027 | 0.05 | 0.011 | 0.031 | 0.002 | 0.015 | 0.060 | 0.003 | 0.003 | 0.0036 | 1648 | 1152 | 1215 | 1159 | 0.64 |
| 3 | AC19 113 | 1.27 | L | 453 | 532 | 28 | 0.162 | 0.058 | 0.801 | 0.003 | 0.015 | 0.201 | 0.040 | 0.027 | 0.05 | 0.011 | 0.031 | 0.002 | 0.015 | 0.060 | 0.003 | 0.003 | 0.0036 | 1647 | 1155 | 1211 | 1160 | 0.64 |
| 4 | AC19 130 | 1.27 | L | 442 | 511 | 25 | 0.161 | 0.050 | 0.754 | 0.002 | 0.010 | 0.178 | 0.033 | 0.020 | 0.04 | 0.008 | 0.029 | 0.002 | 0.014 | 0.060 | 0.003 | 0.002 | 0.004 | 1647 | 1146 | 1217 | 1193 | 0.64 |
| 5 | AC19 135 | 1.27 | L | 449 | 515 | 26 | 0.161 | 0.052 | 0.765 | 0.003 | 0.012 | 0.185 | 0.039 | 0.019 | 0.03 | 0.009 | 0.034 | 0.002 | 0.016 | 0.061 | 0.003 | 0.002 | 0.0034 | 1648 | 1152 | 1218 | 1195 | 0.64 |
| 6 | AC19 123 | 1.27 | L | 442 | 509 | 26 | 0.162 | 0.047 | 0.766 | 0.001 | 0.011 | 0.186 | 0.028 | 0.024 | 0.04 | 0.009 | 0.034 | 0.002 | 0.016 | 0.062 | 0.003 | 0.002 | 0.0042 | 1648 | 1146 | 1216 | 1168 | 0.64 |
| 7 | AC19 112 | 1.27 | L | 459 | 532 | 26 | 0.158 | 0.058 | 0.801 | 0.003 | 0.015 | 0.201 | 0.040 | 0.027 | 0.05 | 0.011 | 0.031 | 0.002 | 0.015 | 0.060 | 0.003 | 0.003 | 0.0036 | 1648 | 1162 | 1215 | 1194 | 0.64 |
| 8 | AC19 119 | 1.27 | L | 480 | 539 | 25 | 0.158 | 0.047 | 0.766 | 0.001 | 0.011 | 0.186 | 0.028 | 0.024 | 0.04 | 0.009 | 0.034 | 0.002 | 0.016 | 0.062 | 0.003 | 0.002 | 0.0042 | 1648 | 1141 | 1219 | 1188 | 0.64 |
| 9 | AC19 110 | 1.27 | L | 449 | 520 | 26 | 0.157 | 0.058 | 0.801 | 0.003 | 0.015 | 0.201 | 0.040 | 0.027 | 0.05 | 0.011 | 0.031 | 0.002 | 0.015 | 0.060 | 0.003 | 0.003 | 0.0036 | 1647 | 1173 | 1210 | 1190 | 0.64 |
| 10 | AC19 120 | 1.27 | L | 469 | 530 | 26 | 0.161 | 0.047 | 0.766 | 0.001 | 0.011 | 0.186 | 0.028 | 0.024 | 0.04 | 0.009 | 0.034 | 0.002 | 0.016 | 0.062 | 0.003 | 0.002 | 0.0042 | 1647 | 1144 | 1219 | 1205 | 0.64 |
| 11 | AC19 121 | 1.27 | L | 475 | 536 | 25 | 0.155 | 0.047 | 0.766 | 0.001 | 0.011 | 0.186 | 0.028 | 0.024 | 0.04 | 0.009 | 0.034 | 0.002 | 0.016 | 0.062 | 0.003 | 0.002 | 0.0042 | 1650 | 1141 | 1216 | 1170 | 0.64 |
| 12 | AC19 158 | 1.42 | L | 471 | 530 | 26 | 0.160 | 0.051 | 0.799 | 0.002 | 0.006 | 0.184 | 0.027 | 0.025 | 0.05 | 0.007 | 0.033 | 0.002 | 0.017 | 0.059 | 0.003 | 0.002 | 0.0047 | 1648 | 1150 | 1213 | 1179 | 0.64 |
| 13 | AC19 145 | 1.27 | L | 439 | 502 | 25 | 0.166 | 0.051 | 0.763 | 0.002 | 0.009 | 0.212 | 0.031 | 0.018 | 0.04 | 0.007 | 0.025 | 0.002 | 0.016 | 0.057 | 0.004 | 0.002 | 0.0066 | 1645 | 1153 | 1209 | 1165 | 0.64 |
| 14 | AC19 146 | 1.27 | L | 441 | 518 | 26 | 0.155 | 0.051 | 0.763 | 0.002 | 0.009 | 0.212 | 0.031 | 0.018 | 0.04 | 0.007 | 0.025 | 0.002 | 0.016 | 0.057 | 0.004 | 0.002 | 0.0066 | 1647 | 1143 | 1205 | 1159 | 0.64 |
| 15 | AC19 160 | 1.42 | L | 434 | 505 | 25 | 0.160 | 0.051 | 0.799 | 0.002 | 0.006 | 0.184 | 0.027 | 0.025 | 0.05 | 0.007 | 0.033 | 0.002 | 0.017 | 0.059 | 0.003 | 0.002 | 0.0047 | 1647 | 1143 | 1214 | 1200 | 0.64 |
| 16 | AC19 151 | 1.27 | L | 455 | 520 | 26 | 0.161 | 0.051 | 0.763 | 0.002 | 0.009 | 0.212 | 0.031 | 0.018 | 0.04 | 0.007 | 0.025 | 0.002 | 0.016 | 0.057 | 0.004 | 0.002 | 0.0066 | 1648 | 1152 | 1211 | 1161 | 0.64 |
| 17 | AC19 143 | 1.27 | L | 483 | 544 | 24 | 0.158 | 0.052 | 0.765 | 0.003 | 0.012 | 0.185 | 0.039 | 0.019 | 0.03 | 0.009 | 0.034 | 0.002 | 0.016 | 0.061 | 0.003 | 0.002 | 0.0034 | 1648 | 1146 | 1208 | 1174 | 0.64 |
| 18 | AC19 127 | 1.27 | L | 462 | 529 | 25 | 0.159 | 0.050 | 0.754 | 0.002 | 0.010 | 0.178 | 0.033 | 0.020 | 0.04 | 0.008 | 0.029 | 0.002 | 0.014 | 0.060 | 0.003 | 0.002 | 0.004 | 1647 | 1146 | 1215 | 1178 | 0.64 |
| 19 | AC19 153 | 1.27 | L | 440 | 514 | 26 | 0.160 | 0.051 | 0.799 | 0.002 | 0.006 | 0.184 | 0.027 | 0.025 | 0.05 | 0.007 | 0.033 | 0.002 | 0.017 | 0.059 | 0.003 | 0.002 | 0.0047 | 1647 | 1164 | 1214 | 1176 | 0.64 |
| 20 | AC19 126 | 1.27 | L | 460 | 526 | 26 | 0.160 | 0.050 | 0.754 | 0.002 | 0.010 | 0.178 | 0.033 | 0.020 | 0.04 | 0.008 | 0.029 | 0.002 | 0.014 | 0.060 | 0.003 | 0.002 | 0.004 | 1645 | 1144 | 1213 | 1160 | 0.64 |
| 21 | AC19 129 | 1.27 | L | 470 | 537 | 25 | 0.159 | 0.050 | 0.754 | 0.002 | 0.010 | 0.178 | 0.033 | 0.020 | 0.04 | 0.008 | 0.029 | 0.002 | 0.014 | 0.060 | 0.003 | 0.002 | 0.004 | 1650 | 1150 | 1215 | 1160 | 0.64 |
| 22 | AC19 152 | 1.42 | L | 460 | 515 | 26 | 0.163 | 0.051 | 0.799 | 0.002 | 0.006 | 0.184 | 0.027 | 0.025 | 0.05 | 0.007 | 0.033 | 0.002 | 0.017 | 0.059 | 0.003 | 0.002 | 0.0047 | 1648 | 1152 | 1218 | 1204 | 0.64 |
| 23 | AC19 156 | 1.42 | L | 465 | 519 | 26 | 0.163 | 0.051 | 0.799 | 0.002 | 0.006 | 0.184 | 0.027 | 0.025 | 0.05 | 0.007 | 0.033 | 0.002 | 0.017 | 0.059 | 0.003 | 0.002 | 0.0047 | 1648 | 1155 | 1217 | 1179 | 0.64 |
| 24 | AC19 140 | 1.27 | L | 488 | 552 | 24 | 0.156 | 0.052 | 0.765 | 0.003 | 0.012 | 0.185 | 0.039 | 0.019 | 0.03 | 0.009 | 0.034 | 0.002 | 0.016 | 0.061 | 0.003 | 0.002 | 0.0034 | 1647 | 1135 | 1214 | 1160 | 0.64 |
| 25 | AC19 132 | 1.27 | L | 453 | 522 | 25 | 0.160 | 0.050 | 0.754 | 0.002 | 0.010 | 0.178 | 0.033 | 0.020 | 0.04 | 0.008 | 0.029 | 0.002 | 0.014 | 0.060 | 0.003 | 0.002 | 0.004 | 1647 | 1146 | 1217 | 1162 | 0.64 |
| 26 | AC19 118 | 1.27 | L | 483 | 552 | 23 | 0.156 | 0.047 | 0.766 | 0.001 | 0.011 | 0.186 | 0.028 | 0.024 | 0.04 | 0.009 | 0.034 | 0.002 | 0.016 | 0.062 | 0.003 | 0.002 | 0.0042 | 1648 | 1148 | 1218 | 1160 | 0.64 |
| 27 | AC19 116 | 1.27 | L | 475 | 544 | 24 | 0.148 | 0.047 | 0.766 | 0.001 | 0.011 | 0.186 | 0.028 | 0.024 | 0.04 | 0.009 | 0.034 | 0.002 | 0.016 | 0.062 | 0.003 | 0.002 | 0.0042 | 1647 | 1148 | 1216 | 1169 | 0.64 |

FIG. 8

| | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|
| 28 | ACL9 141 | 1.27 | L | 467 | 532 | 25 | 0.156 | 0.052 | 0.765 | 0.003 | 0.012 | 0.185 | 0.039 | 0.019 | 0.03 | 0.009 | 0.034 | 0.002 | 0.016 | 0.061 | 0.003 | 0.002 | 0.0034 | 1650 | 1143 | 1218 | 1162 | 0.64 |
| 29 | ACL9 124 | 1.27 | L | 454 | 518 | 25 | 0.162 | 0.050 | 0.754 | 0.002 | 0.010 | 0.178 | 0.033 | 0.020 | 0.04 | 0.008 | 0.029 | 0.002 | 0.014 | 0.060 | 0.003 | 0.002 | 0.004 | 1647 | 1146 | 1217 | 1160 | 0.64 |
| 30 | ACL9 159 | 1.42 | L | 467 | 523 | 26 | 0.159 | 0.051 | 0.799 | 0.002 | 0.006 | 0.184 | 0.027 | 0.025 | 0.05 | 0.007 | 0.033 | 0.002 | 0.017 | 0.059 | 0.003 | 0.002 | 0.0047 | 1648 | 1141 | 1222 | 1194 | 0.64 |
| 31 | ACL9 161 | 1.42 | L | 430 | 498 | 27 | 0.170 | 0.051 | 0.799 | 0.002 | 0.006 | 0.184 | 0.027 | 0.025 | 0.05 | 0.007 | 0.033 | 0.002 | 0.017 | 0.059 | 0.003 | 0.002 | 0.0047 | 1648 | 1139 | 1216 | 1192 | 0.64 |
| 32 | ACL9 137 | 1.27 | L | 435 | 505 | 27 | 0.159 | 0.052 | 0.765 | 0.003 | 0.012 | 0.185 | 0.039 | 0.019 | 0.03 | 0.009 | 0.034 | 0.002 | 0.016 | 0.061 | 0.003 | 0.002 | 0.0034 | 1647 | 1146 | 1216 | 1160 | 0.64 |
| 33 | ACL9 142 | 1.27 | L | 478 | 536 | 24 | 0.153 | 0.052 | 0.765 | 0.003 | 0.012 | 0.185 | 0.039 | 0.019 | 0.03 | 0.009 | 0.034 | 0.002 | 0.016 | 0.061 | 0.003 | 0.002 | 0.0034 | 1648 | 1146 | 1215 | 1160 | 0.64 |
| 34 | ACL9 138 | 1.27 | L | 487 | 554 | 23 | 0.151 | 0.052 | 0.765 | 0.003 | 0.012 | 0.185 | 0.039 | 0.019 | 0.03 | 0.009 | 0.034 | 0.002 | 0.016 | 0.061 | 0.003 | 0.002 | 0.0034 | 1648 | 1141 | 1218 | 1187 | 0.64 |
| 35 | ACL9 134 | 1.27 | L | 460 | 519 | 26 | 0.162 | 0.052 | 0.765 | 0.003 | 0.012 | 0.185 | 0.039 | 0.019 | 0.03 | 0.009 | 0.034 | 0.002 | 0.016 | 0.061 | 0.003 | 0.002 | 0.0034 | 1648 | 1150 | 1211 | 1180 | 0.64 |
| 36 | ACL9 122 | 1.27 | L | 487 | 546 | 23 | 0.156 | 0.047 | 0.766 | 0.001 | 0.011 | 0.186 | 0.028 | 0.024 | 0.04 | 0.009 | 0.034 | 0.002 | 0.016 | 0.062 | 0.003 | 0.002 | 0.0042 | 1647 | 1139 | 1204 | 1175 | 0.64 |
| 37 | ACL9 148 | 1.27 | L | 448 | 512 | 25 | 0.165 | 0.051 | 0.763 | 0.002 | 0.009 | 0.212 | 0.031 | 0.018 | 0.04 | 0.007 | 0.025 | 0.002 | 0.016 | 0.057 | 0.004 | 0.002 | 0.0066 | 1648 | 1146 | 1209 | 1158 | 0.64 |
| 38 | ACL9 117 | 1.27 | L | 450 | 515 | 24 | 0.158 | 0.047 | 0.766 | 0.001 | 0.011 | 0.186 | 0.028 | 0.024 | 0.04 | 0.009 | 0.034 | 0.002 | 0.016 | 0.062 | 0.003 | 0.002 | 0.0042 | 1647 | 1148 | 1210 | 1180 | 0.64 |
| 39 | ACL9 147 | 1.27 | L | 435 | 509 | 25 | 0.156 | 0.051 | 0.763 | 0.002 | 0.009 | 0.212 | 0.031 | 0.018 | 0.04 | 0.007 | 0.025 | 0.002 | 0.016 | 0.057 | 0.004 | 0.002 | 0.0066 | 1648 | 1150 | 1205 | 1160 | 0.64 |
| 40 | ACL9 136 | 1.27 | L | 471 | 528 | 25 | 0.159 | 0.052 | 0.765 | 0.003 | 0.012 | 0.185 | 0.039 | 0.019 | 0.03 | 0.009 | 0.034 | 0.002 | 0.016 | 0.061 | 0.003 | 0.002 | 0.0034 | 1647 | 1139 | 1214 | 1189 | 0.64 |
| 41 | ACL9 144 | 1.27 | L | 451 | 513 | 25 | 0.164 | 0.051 | 0.763 | 0.002 | 0.009 | 0.212 | 0.031 | 0.018 | 0.04 | 0.007 | 0.025 | 0.002 | 0.016 | 0.057 | 0.004 | 0.002 | 0.0066 | 1645 | 1141 | 1211 | 1162 | 0.64 |
| 42 | ACL9 150 | 1.27 | L | 442 | 499 | 26 | 0.168 | 0.051 | 0.763 | 0.002 | 0.009 | 0.212 | 0.031 | 0.018 | 0.04 | 0.007 | 0.025 | 0.002 | 0.016 | 0.057 | 0.004 | 0.002 | 0.0066 | 1648 | 1150 | 1215 | 1178 | 0.64 |
| 43 | ACL9 133 | 1.27 | L | 500 | 553 | 24 | 0.154 | 0.050 | 0.754 | 0.002 | 0.010 | 0.178 | 0.033 | 0.020 | 0.04 | 0.008 | 0.029 | 0.002 | 0.014 | 0.060 | 0.003 | 0.002 | 0.004 | 1648 | 1148 | 1210 | 1177 | 0.64 |
| 44 | ACL9 125 | 1.27 | L | 501 | 553 | 24 | 0.152 | 0.050 | 0.754 | 0.002 | 0.010 | 0.178 | 0.033 | 0.020 | 0.04 | 0.008 | 0.029 | 0.002 | 0.014 | 0.060 | 0.003 | 0.002 | 0.004 | 1648 | 1150 | 1217 | 1195 | 0.64 |
| 45 | ACN5 043 | 1.42 | L | 509 | 565 | 24 | 0.154 | 0.051 | 0.852 | 0.002 | 0.012 | 0.200 | 0.024 | 0.017 | 0.03 | 0.002 | 0.025 | 0.002 | 0.015 | 0.059 | 0.003 | 0.002 | 0.0041 | 1647 | 1150 | 1206 | 1185 | 0.64 |
| 46 | ACN5 052 | 1.47 | L | 458 | 529 | 28 | 0.164 | 0.051 | 0.852 | 0.002 | 0.012 | 0.200 | 0.024 | 0.017 | 0.03 | 0.002 | 0.025 | 0.002 | 0.015 | 0.059 | 0.003 | 0.002 | 0.0041 | 1650 | 1173 | 1211 | 1187 | 0.66 |
| 47 | ACN5 046 | 1.47 | L | 469 | 533 | 26 | 0.162 | 0.051 | 0.852 | 0.002 | 0.012 | 0.200 | 0.024 | 0.017 | 0.03 | 0.002 | 0.025 | 0.002 | 0.015 | 0.059 | 0.003 | 0.002 | 0.0041 | 1648 | 1150 | 1213 | 1181 | 0.70 |
| 48 | ACN5 049 | 1.01 | L | 474 | 544 | 24 | 0.163 | 0.051 | 0.852 | 0.002 | 0.012 | 0.200 | 0.024 | 0.017 | 0.03 | 0.002 | 0.025 | 0.002 | 0.015 | 0.059 | 0.003 | 0.002 | 0.0041 | 1647 | 1180 | 1209 | 1160 | 0.70 |
| 49 | ACN5 047 | 1.01 | L | 458 | 546 | 24 | 0.154 | 0.051 | 0.852 | 0.002 | 0.012 | 0.200 | 0.024 | 0.017 | 0.03 | 0.002 | 0.025 | 0.002 | 0.015 | 0.059 | 0.003 | 0.002 | 0.0041 | 1645 | 1187 | 1206 | 1185 | 0.70 |
| 50 | ACN5 045 | 1.47 | L | 480 | 534 | 27 | 0.164 | 0.051 | 0.852 | 0.002 | 0.012 | 0.200 | 0.024 | 0.017 | 0.03 | 0.002 | 0.025 | 0.002 | 0.015 | 0.059 | 0.003 | 0.002 | 0.0041 | 1650 | 1155 | 1208 | 1181 | 0.70 |
| 51 | ACN5 044 | 1.47 | L | 498 | 551 | 25 | 0.157 | 0.051 | 0.852 | 0.002 | 0.012 | 0.200 | 0.024 | 0.017 | 0.03 | 0.002 | 0.025 | 0.002 | 0.015 | 0.059 | 0.003 | 0.002 | 0.0041 | 1650 | 1148 | 1214 | 1183 | 0.70 |
| 52 | ACN5 048 | 1.01 | L | 471 | 544 | 25 | 0.164 | 0.051 | 0.852 | 0.002 | 0.012 | 0.200 | 0.024 | 0.017 | 0.03 | 0.002 | 0.025 | 0.002 | 0.015 | 0.059 | 0.003 | 0.002 | 0.0041 | 1645 | 1171 | 1211 | 1160 | 0.70 |

Fig 8 cont. : Actual Process Parameters

COLD ROLLED STEEL SHEET

CROSS REFERENCE TO RELATED APPLICATIONS

This application depends from and claims priority to U.S. Provisional Application No. 63/143,448 filed Jan. 29, 2021, the entire contents of which are incorporated herein by reference.

FIELD

The invention relates to cold rolled steel sheet.

BACKGROUND

Cold rolled steel sheet meeting ASTM A1008 HSLAS-F Gr60 typically has a relatively large amount of Niobium, which is relatively expensive.

SUMMARY

Forming one aspect of the invention is a cold rolled high strength steel sheet comprising, in weight percent:

| | |
|---|---|
| C: 0.03~0.10 | Al: 0~0.06 |
| Si: 0~0.6 | Ca: 0~0.006 |
| Mn: 0.5~1.5 | P: 0~0.02 |
| Cu: 0~1.0 | S: 0~0.005 |
| Ni: 0~1.0 | |
| Nb: 0 to 0.06 | |
| Ti: 0 to 0.1 | |
| Mo: 0 to 0.5 | |
| Cr: 0~1.0 | |

N: 0.0001~0.006 and further comprising iron and incidental impurities, the sheet having: ferrite and pearlite composing 80% or more, in area fraction, of the microstructure; yield strength of 60 ksi or more; elongation of at least 23% and a n-value of at least 0.14.

According to other aspects, the weight percent of Mo is optionally no more than 0.060 and the pearlite content can be 20% or less based on the area fraction.

Forming yet another aspect of the invention is a method for use with a steel slab having, in weight percent:

C: 0.03~0.10
Si: 0~0.6
Mn: 0.5~1.5
Cu: 0~1.0
Ni: 0~1.0
Nb: 0 to 0.06
Ti: 0 to 0.1
Mo: 0 to 0.5
Cr: 0~1.0
Al: 0~0.06
Ca: 0~0.006
P: 0~0.02
S: 0~0.005
N: 0.0001~0.006 and further comprising iron and incidental impurities, the method comprising:

heating the slab to a temperature of 1050° C. to 1150° C. to produce a heated slab;

rolling the heated slab once at a rolling reduction rate of 20 to 80% in a temperature range above the austenite recrystallization temperature to produce a rolled slab;

rolling the rolled slab two or more times at a rolling reduction ratio of 40% to 80% in a temperature range below austenite recrystallization temperature and above Ar3 to produce a rolled sheet;

cooling the rolled sheet at a cooling rate of 20° C. to 50° C./sec to produce a cooled sheet;

hot rolling the cooled sheet at a temperature of 300° C. to 690° C. to produce a hot rolled sheet;

cold-working the hot rolled sheet at a reduction rate of 30% to 80% to produce a cold rolled sheet; and annealing the cold rolled sheet for 10 hours or more at 1300° F. or more.

According to another aspect, the steel slab can have Mo in a weight percent no more than 0.06.

According to another aspect, the austenite grain size in the rolled sheet can be 50 μm or less.

BRIEF DESCRIPTION OF THE DRAWINGS

FIG. 1: illustrates Nital Etch-Middle microstructure of a sheet material.

FIG. 2: illustrates Nital Etch-Middle microstructure of a sheet material of a finished product according to some aspects as provided herein.

FIG. 3: illustrates L-orientation YS Capability of a sheet material of a finished product according to some aspects as provided herein.

FIG. 4: illustrates L-orientation TS Capability of a sheet material of a finished product according to some aspects as provided herein.

FIG. 5: illustrates L-orientation Elongation Capability of a sheet material of a finished product according to some aspects as provided herein.

FIG. 6: illustrates L-orientation n value Capability of a sheet material of a finished product according to some aspects as provided herein.

FIG. 7: illustrates L-orientation Yield Strength vs. Gauge of a sheet material of a finished product according to some aspects as provided herein.

FIG. 8: illustrates process parameters of a sheet material of a finished product according to some aspects as provided herein.

DESCRIPTION

Non-limiting embodiments of the invention are hereinafter described.

Sheet Material

Sheet material according to a non-limiting embodiment of the invention comprises, in weight percent:

| | |
|---|---|
| C: 0.03~0.10 | Ca: 0~0.006 |
| Si: 0~0.6 | P: 0~0.02 |
| Mn: 0.5~1.5 | S: 0~0.005 |
| Cu: 0~1.0 | |
| Ni: 0~1.0 | |
| Nb: 0 to 0.06 | |
| Ti: 0 to 0.1 | |
| Mo: 0 to 0.06 | |
| Cr: 0~1.0 | |
| Al: 0~0.06 | |

N: 0.0001~0.006 and further comprising iron and incidental impurities, wherein the sheet has ferrite and pearlite composing 80% or more, in area fraction, of the microstructure has yield strength of 60 ksi or more
elongation of at least 23%
has an n-value of at least 0.14.
has pearlite content no more than 20% based on area fraction.

Method

The method is for use with a steel slab having, in weight percent: C: 0.03~0.10
Si: 0~0.6
Mn: 0.5~1.5
Cu: 0~1.0
Ni: 0~1.0
Nb: 0 to 0.06
Ti: 0 to 0.1
Mo: 0 to 0.06
Cr: 0~1.0
Al: 0~0.06
Ca: 0~0.006
P: 0~0.02
S: 0~0.005
N: 0.0001~0.006
and further comprising iron and incidental impurities, the method comprising:

heating the slab to a temperature of 1050° C. to 1150° C. to produce a heated slab;
rolling the heated slab once at a rolling reduction rate of 20% to 80% in a temperature range above the austenite recrystallization temperature to produce a rolled slab;
rolling the rolled slab two or more times at a rolling reduction ratio of 40% to 80% in a temperature range below austenite recrystallization temperature and above Ar3 to produce a rolled sheet;
cooling the rolled sheet at a cooling rate of 20° C. to 50° C./sec to produce a cooled sheet;
hot rolling the cooled sheet at a temperature of 300° C. to 690° C. to produce a hot rolled sheet;
cold-working the hot rolled sheet at a reduction rate of 30% to 80% to produce a cold rolled sheet; and
annealing the cold rolled sheet for 10 hours or more at 1300° F. or more.

Experimental

Liquid metal having the following composition
C: 0.03~0.10
Si: 0~0.6
Mn: 0.5 ~1.5
Cu: 0~1.0
Ni: 0~1.0
Nb: 0 to 0.06
Ti: 0 to 0.1
Mo: 0 to 0.06%
Cr: 0~1.0
Al: 0~0.06
Ca: 0~0.006
P: 0~.02
S: 0~0.005
N: 0.0001 ~0.006
and further comprising iron and incidental impurities, was cast into 78 millimeter (mm) slab at Algoma Steel, Ontario. The slab was cleaned by pickling to remove the oxide layer, then used in the following method to produce fifty two (52) coils. Briefly, the slab is heated to a temperature of 1050° C. to 1150° C. to produce a heated slab; the heated slab if rolled once at a rolling reduction rate of 20% to 80% in a temperature range above the austenite recrystallization temperature to produce a rolled slab; the rolled slab is rolled two or more times at a rolling reduction ratio of 40% to 80% in a temperature range below austenite recrystallization temperature and above Ar3 to produce a rolled sheet; the rolled sheet is cooled at a cooling rate of 20° C. to 50° C. / sec to produce a cooled sheet; the cooled sheet is hot rolled at a temperature of 300° C. to 690° C. to produce a hot rolled sheet; the hot rolled sheet is cold-worked at a reduction rate of 30% to 80% to produce a cold rolled sheet; and the cold rolled sheet is annealed for 10 hours or more at 1300° F. or more.

Each coil was tested for coil chemistry, and the process parameters were monitored during production; details of the same are provided in FIG. 8.

Micros were cut in the longitudinal direction of the rolled slab [after cold reduction, preceding annealing] and mounted, ground, polished and Nital etched to reveal the microstructures, as shown in FIG. 1. The elongated grains visible in FIG. 1 clearly demonstrate that large amount of permanent deformation induced microstructure of full hard strip.

The finished product was also inspected after Nital etching as shown in FIG. 2. The fully recovered and recrystallized uniaxial grains and partially recovered grains at centerline clearly demonstrate that ideal microstructure of post annealing.

The fifty two (52) rolls produced were tested for mechanical properties against SAE J2340 420X; the results are provided in FIGS. 3-7. Persons of ordinary skill will appreciate that, surprisingly, notwithstanding the relatively low amounts of Niobium, the coils meet the standard.

Whereas two specific embodiments are herein shown and described, persons of ordinary skill will readily appreciate that variations are possible. Accordingly, the invention should be understood to be limited only by the accompanying claims, purposively construed.

The invention claimed is:

1. A cold rolled high strength steel sheet comprising, in weight percent:
C: 0.03 to 0.10
Si: 0 to 0.6
Mn: 0.5 to 1.5
Cu: 0 to 1.0
Ni: 0 to 1.0
Nb: 0 to 0.06
Ti: 0 to 0.1
Mo: 0 to 0.5
Cr: 0 to 1.0
Al: 0 to 0.06
N: 0.0001 to 0.006
Ca: 0 to 0.006
P: 0 to 0.02
S: 0 to 0.005
and further comprising iron and incidental impurities,
wherein the sheet has ferrite and pearlite composing 80% or more, in area fraction, of the microstructure has yield strength of 60 ksi or more, elongation of at least 23%, and an n-value of at least 0.14.

2. The steel sheet according to claim 1, wherein the weight percent of Mo is no more than 0.060.

3. The steel sheet according to claim 1, wherein pearlite content is greater than 0% and 20% or less based on the area fraction.

4. The steel sheet according to claim 2, wherein pearlite content is greater than 0% and 20% or less based on the area fraction.

* * * * *